US008072407B2

(12) United States Patent
Tanaka et al.

(10) Patent No.: US 8,072,407 B2
(45) Date of Patent: Dec. 6, 2011

(54) LIQUID CRYSTAL DISPLAY DEVICE

(75) Inventors: Ryo Tanaka, Yokohama (JP); Tetsuya Kobayashi, Kawasaki (JP); Shinpei Nagatani, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 1472 days.

(21) Appl. No.: 11/438,252

(22) Filed: May 23, 2006

(65) Prior Publication Data

US 2007/0120799 A1 May 31, 2007

(30) Foreign Application Priority Data

May 24, 2005 (JP) ..... 2005-151032

(51) Int. Cl.
*G09G 3/36* (2006.01)

(52) U.S. Cl. ..... 345/94; 345/95; 345/208; 345/210; 345/89; 345/690

(58) Field of Classification Search ..... 345/87–104, 345/204–215, 690–699
See application file for complete search history.

(56) References Cited

U.S. PATENT DOCUMENTS 6,094,243 A * 7/2000 Yasunishi ..... 349/33
6,229,583 B1 * 5/2001 Yasunishi ..... 349/33
6,473,117 B1 * 10/2002 Iba ..... 348/87
6,683,595 B2 * 1/2004 Ikeda ..... 345/95
6,809,717 B2 10/2004 Asao et al.
6,870,530 B2 * 3/2005 Bu et al. ..... 345/208
6,894,671 B2 * 5/2005 Yamamoto et al. ..... 345/89
6,903,716 B2 * 6/2005 Kawabe et al. ..... 345/99
6,924,824 B2 * 8/2005 Adachi et al. ..... 345/690
7,173,609 B2 * 2/2007 Sato et al. ..... 345/204
7,280,103 B2 10/2007 Taoka et al.
7,333,101 B2 * 2/2008 Bu et al. ..... 345/208

(Continued)

FOREIGN PATENT DOCUMENTS

JP 05-068221 3/1993

(Continued)

OTHER PUBLICATIONS

Taiichiro, Kurita, The Institute of Electronics, Information and Communication Engineers, Technical Report, "Fundamental Deterioration of Picture Quality for Moving Images Displayed on LCDs and Methods for Improvement, " EID200-47 p. 13-19 (Sep. 2000).

(Continued)

*Primary Examiner* — Lun-Yi Lao
*Assistant Examiner* — Gene W Lee
(74) *Attorney, Agent, or Firm* — Harness, Dickey & Pierce, PLC

(57) ABSTRACT

A liquid crystal display aimed at improving response speed, movie characteristics and viewing angle dependence of gradation is provided as having a liquid crystal panel including a plurality of gate lined selecting pixels and a plurality of data lines supplying pixel data, and a data driver dividing one frame into a plurality of fields to thereby convert a frame data into a field data, and supplying the field data to the data line, wherein in the last field out of the plurality of fields, the data line is applied with a first constant voltage, for the frame data ranging from the minimum gradation value to a first gradation value, and in the top field out of the plurality of fields, the data line is applied with a second constant voltage larger than the first constant voltage, for the frame data ranging from a second gradation value to the maximum gradation value.

2 Claims, 6 Drawing Sheets

U.S. PATENT DOCUMENTS

| | | | | |
|---|---|---|---|---|
| 7,532,186 | B2 * | 5/2009 | Tsai et al. | 345/89 |
| 7,800,597 | B2 * | 9/2010 | Hong | 345/204 |
| 7,800,691 | B2 | 9/2010 | Oyaizu et al. | |
| 2001/0048420 | A1 * | 12/2001 | Yamamoto et al. | 345/89 |
| 2001/0052886 | A1 * | 12/2001 | Ikeda | 345/87 |
| 2002/0015017 | A1 * | 2/2002 | Kwag | 345/89 |
| 2002/0140691 | A1 * | 10/2002 | Sato et al. | 345/212 |
| 2002/0171640 | A1 * | 11/2002 | Bu et al. | 345/208 |
| 2003/0107538 | A1 | 6/2003 | Asao et al. | |
| 2003/0169247 | A1 * | 9/2003 | Kawabe et al. | 345/204 |
| 2003/0179221 | A1 * | 9/2003 | Nitta et al. | 345/690 |
| 2003/0218587 | A1 * | 11/2003 | Ikeda | 345/87 |
| 2004/0155847 | A1 | 8/2004 | Taoka et al. | |
| 2004/0239612 | A1 | 12/2004 | Asao et al. | |
| 2004/0246216 | A1 * | 12/2004 | Hosaka | 345/87 |
| 2004/0246224 | A1 * | 12/2004 | Tsai et al. | 345/100 |
| 2005/0104833 | A1 * | 5/2005 | Ochi et al. | 345/96 |
| 2005/0162416 | A1 * | 7/2005 | Bu et al. | 345/208 |
| 2005/0253785 | A1 * | 11/2005 | Miyasaka et al. | 345/63 |
| 2006/0038837 | A1 * | 2/2006 | Hong | 345/691 |
| 2006/0197732 | A1 | 9/2006 | Oyaizu et al. | |
| 2007/0085794 | A1 * | 4/2007 | Kawabe et al. | 345/89 |
| 2009/0153458 | A1 * | 6/2009 | Kojima et al. | 345/89 |

FOREIGN PATENT DOCUMENTS

| | | |
|---|---|---|
| JP | 06-230750 | 8/1994 |
| JP | 2000-338464 | 12/2000 |
| JP | 2002-132224 | 5/2002 |
| JP | 2004-177575 | 6/2004 |
| JP | 2004-240317 | 8/2004 |
| JP | 2006-221060 | 8/2006 |
| WO | WO94/19720 | 9/1994 |

OTHER PUBLICATIONS

Office Action dated Oct. 5, 2010 in corresponding Japanese Patent Application No. 2005-151032.

Office Action dated Dec. 14, 2010 in corresponding Japanese Patent Application No. 2005-151032.

* cited by examiner

LIQUID CRYSTAL DISPLAY DEVICE

CROSS-REFERENCE TO RELATED APPLICATIONS

This application is based upon and claims the benefit of priority from the prior Japanese Patent Application No. 2005-151032, filed on May 24, 2005, the entire contents of which are incorporated herein by reference.

BACKGROUND OF THE INVENTION

1. Field of the Invention

The present invention relates to a liquid crystal display device.

2. Description of the Related Art

Liquid crystal display devices have widely been disseminated as monitor devices of PCs (personal computers) from the viewpoints of their thinness, light-weight and low power consumption, wherein recent expansion of a market of digital television set has raised an increasing demand on TV-use liquid crystal panel capable of realizing high resolution, for which display quality comparable to that of CRT is required. In particular, liquid crystal display device is known to be slow in response speed when compared with CRT, so that it has been understood as an urgent mission to improve the response speed and to realize excellent movie characteristics.

One possible reason for such low response speed of the liquid crystal display device is that the liquid crystal molecule per se has only a slow response, and cannot make a response within a single frame under low temperatures or low gradation state, and this consequently raises a problem of causing blurring and afterimage in the movie. The liquid crystal display device uses light from an illumination device placed on the back side for the display, wherein the illumination device is kept active throughout one frame, and is therefore known to be inferior in the movie characteristics as compared with CRT and plasma display device which adopt pulse illumination within one frame. The former is referred to as "hold-type display", and the latter is referred to as "impulse-type display". The hold-type display is described in Non-Patent Document 1 listed later.

One of the techniques of improving the response speed of the liquid crystal display device per se is the overdrive technique shown in FIG. 6, which has widely been known. In the drawings of the normal operation 801 and the overdrive operation 802, the upper halves show response waveforms of luminance, and the lower halves show data waveforms. In the normal operation 801, an effective voltage 803 expresses an effective voltage of the data waveform, wherein response time T2 represents a response time of luminance within a single frame FR1 (duration of time having a luminance ratio of 10% to 90% kept therein). In the overdrive operation 802, the effective voltage expressed by the data waveform is increased by an increment 804 from that in the normal operation 801, showing response time T3 of luminance within a single frame FR1 shorter than response time T2.

Liquid crystal generally shows better responsiveness as the voltage applied thereto grows larger. The overdrive operation 802 is a technique of applying, at the rise-up time in the response, a voltage larger than the data voltage to intrinsically be applied so as to accelerate the response of liquid crystal, to thereby improve the response speed at gradation of low response speed. On the contrary, at the fall-down time in the response, the response is accelerated by applying a voltage lower than the intrinsic data voltage.

There are known methods of determining the increment (correction value) 804 of the effective voltage, including a method of determining the correction value for the m-th frame by comparing data between the m-th frame and the (m−1)-th frame; and a method of determining a correction value for the (m−1)-th frame by comparing data among the (m−2)-th frame, the (m−1)-th frame and the m-th frame.

The conventional operation may certainly improve the response speed by applying a voltage larger than the intrinsic data voltage in the period of the first frame (1/operation frequency), but the improvement is achievable only to as short as 16 ms or below, which corresponds to a period of a single frame under a 60-Hz operation, for a gradation range allowing only a low response speed of the liquid crystal per se. This is because too high voltage for accelerating the response may result in overshooting which adversely affect the movie display, so that the voltage value is limitative.

For VA-mode liquid crystal panel, a phenomenon has been confirmed in that disturbance in orientation of the liquid crystal molecules becomes serious under high voltage application. In the VA-mode as shown in FIG. 7, liquid crystal molecules 901 vertically aligned under no applied voltage (in the black level) begin to incline with increase in the applied voltage, as being affected by any structures provided in the panel or by the direction of electric field. In general, a maximum applied voltage gives the white level display, wherein the liquid crystal molecules 902, 903 incline to the largest degree. The liquid crystal molecules 902 express those in the while level display under normal alignment, having a liquid crystal alignment direction 912. The liquid crystal molecules 903 express those in the white level display under abnormal alignment, having a liquid crystal alignment direction 913. It is preferable in the white level display that the liquid crystal molecules incline in the normal direction of alignment, but the inclination under an abrupt voltage application may sometimes result in variation in the direction of alignment.

FIG. 8 is a drawing showing one-frame overdrive operation 1001 and two-frame overdrive operation 1002. In the one-frame overdrive operation 1001, the effective voltage expressed by the data waveform is increased by an increment 1007 as a result of the overdrive only in the first frame FR1. In the two-frame overdrive operation 1002, the effective voltage expressed by the data waveform is increased by an increment 1005 in the first frame FR1, and an absolute value of the effective voltage expressed by the data waveform is increased by an increment 1006 in the second frame FR2. The liquid crystal molecules 902 under the normal alignment shown in FIG. 7 successfully increase the luminance 1004 by the overdrive in the second frame FR2. Whereas, the liquid crystal molecules 903 under the abnormal alignment shown in FIG. 7 undesirably degrade the luminance 1003 in the second frame FR2 due to disturbance in the alignment of liquid crystal.

The liquid crystal molecules under the normal alignment contribute to the luminance to a maximum degree, whereas any molecules departing from such alignment are causative of lowering in the luminance. Also the molecules out of alignment may gradually recover the normal alignment with elapse of time under orientation-limiting force inside the panel, but the lowering in luminance may adversely affect the response waveform in the second frame FR2, or in other words, adversely affect the movie characteristics. Conversion of the data voltage in the second frame FR2 has therefore been necessary.

In this case, it takes two frames (32 ms) to reach the intrinsic data voltage level, and this has been one cause for degrading the movie characteristics.

Another known problem in the liquid crystal display device particularly designed for TV sets relates to that the VA-mode liquid crystal display device causes difference in the luminance and the chromaticity between display in the front view and display in oblique views. More specifically, the display device of this type looks whitish in oblique views due to an excessive luminance, showing a large difference in the chromaticity from the front view, and was therefore inappropriate as a liquid crystal display device possibly viewed also from oblique directions. Such nonconformity is ascribable to that the display by the liquid crystal display device makes use of birefringence, and that the VA-mode device causes difference in the gradation-luminance characteristics between oblique views and the front view, as the liquid crystal molecules incline to a larger degree.

FIG. 9A is a drawing showing the liquid crystal molecules as viewed from this side. Liquid crystal molecules 401 incline towards this side, and liquid crystal molecules 402 incline towards the far side. FIG. 9B is a drawing showing relations between applied voltage (gradation) and transmittance (luminance). A characteristic curve 411 expresses the characteristics observed in the front view, a characteristic curve 412 at 60° on the far side, a characteristic curve 413 at 60° upper in the quadrisection, and a characteristic curve 414 at 60° on this side.

The liquid crystal molecules 401 inclined towards this side and the liquid crystal molecules 402 inclined towards the far side differ from each other in the resultant gradation-luminance characteristics in oblique views, and the sum of the both gives an apparent gradation-luminance characteristic, and this raises differences in the luminance and the chromaticity in the oblique views.

Several methods have already been proposed in view of improving the viewing-angle-dependent gradation characteristics. Principles of these methods are based on provision of a plurality of gradation-luminance characteristics on a time scale so as to moderate the waviness in the gradation-luminance characteristics in the oblique views, and examples of which include a technique of providing a plurality of regions within a single pixel so as to allow different levels of voltage to be applied thereto, to thereby impart a plurality of gradation-luminance characteristics to the pixel; and a technique of applying different levels of voltage on the frame basis, so as to impart a plurality of voltage-luminance characteristics to each frame, to thereby achieve a desired luminance on the time-average basis. These are referred to as half-tone techniques. The techniques or imparting a plurality of gradation-luminance characteristics to a single pixel are typically described in Patent Document 1 listed later.

Watching TV also on the general PC monitors has been becoming more common in these days, and the situation demands improvement in the movie characteristics while also improving the viewing angle characteristics in the VA mode. There is, however, no known technique realizing the both at the same time, and adoption of two or more techniques in combination has undesirably resulted in lowering in the yield ratio and increase in the cost. Now is the time for individual manufacturers to phase into mass production, and the increase in the cost is a critical issue to be overcome.

Patent Document 2 listed below describes a display device capable of displaying an image using a plurality of frames within one second, wherein one frame $F_0$ is displayed as being divided into at least two fields $F_1$, $F_2$, and a desired image is displayed at least in one sub-field 1F in the field $F_1$ with a first luminance Tx, and an image substantially same as that displayed with the first luminance is displayed in the residual one sub-field 2F with a second luminance smaller than the first luminance but larger than 0.

Patent Document 3 describes that one frame is divided into two fields so as to achieve a double-speed operation, while driving a first field using corrected display data calculated from display data after being corrected by a predetermined conversion method, and driving a second field using the display data without such data conversion.

Related arts are disclosed in:

[Patent Document 1] Translated National Publication of Patent Application No. Hei 08-507880;

[Patent Document 2] Japanese Patent Application Laid-open No. 2000-338464;

[Patent Document 3] Japanese Patent Application Laid-open No. 2002-132224; and

[Non-Patent Document 1] The Institute of Electronics, Information and Communication Engineers, Technical Report EID2000-47 p 13-18 (2000-09).

SUMMARY OF THE INVENTION

An object of the present invention is to provide a liquid crystal display device capable of further shortening the response time down from one frame period, making it possible to provide liquid crystal display excellent in movie display, and/or improving the gradation-viewing angle characteristics specific to the VA-mode display.

According to one aspect of the present invention, there is provided a liquid crystal display device having a liquid crystal panel including a plurality of gate lines selecting pixels and a plurality of data lines supplying pixel data; and a data driver dividing one frame into a plurality of fields to thereby convert a frame data into a field data, and supplying the field data to the data line. In the last field out of the plurality of fields, the data line is applied with a first constant voltage, for the frame data ranging from the minimum gradation value to a first gradation value. In the top field out of the plurality of fields, the data line is applied with a second constant voltage larger than the first constant voltage, for the frame data ranging from a second gradation value to the maximum gradation value.

DETAILED DESCRIPTION OF THE PREFERRED EMBODIMENTS

First Embodiment

Figure 1:
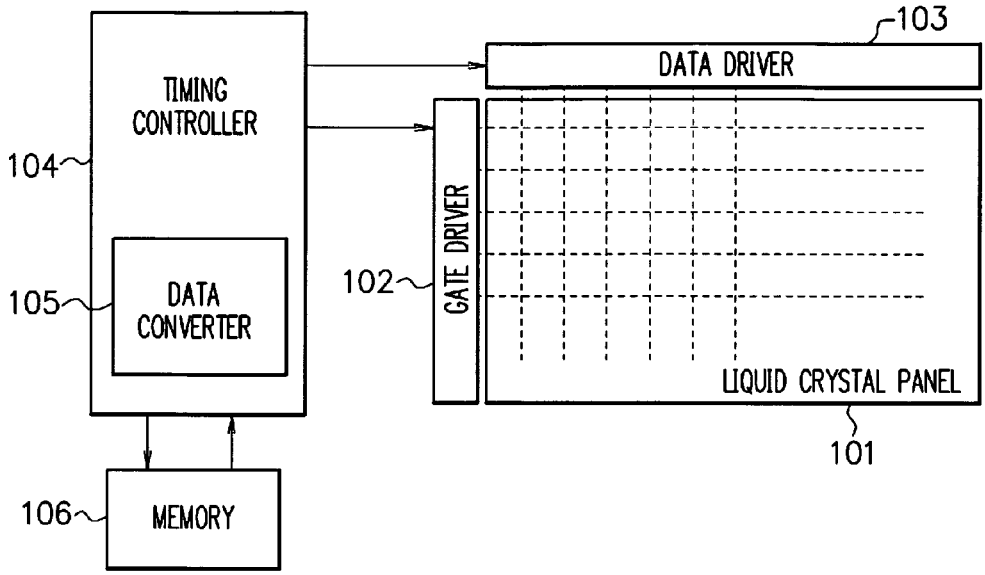
FIG. 1 is a block diagram of a circuit of a first embodiment.

FIG. 1 is a drawing showing an exemplary configuration of the liquid crystal display device according to the first embodiment of the present invention. A timing controller 104 has a data converter 105, allowing itself to write and read to and from a memory 106. A data converter 105 divides one frame into a plurality of fields, and converts a frame data into a field data. A gate driver 102 supplies, by fields, a gate pulse voltage to gate lines (scanning lines) in a liquid crystal panel 101, under control by a timing controller 104. The gate lines are lines for selecting pixels. A data driver 103 supplies, by fields, a data voltage to data lines (signal lines) in the liquid crystal panel 101, under control by the timing controller 104. The data lines are lines for supplying pixel data. The liquid crystal panel 101 has an array substrate on which a plurality of gate lines and a plurality of data lines are crossed thereon, and an active element (TFT: thin film transistor) is formed at every intersection, and an opposing substrate having at least an ITO layer formed thereon. The array substrate and the opposing substrate hold a liquid crystal layer in between. Every pixel has the above-described TFT disposed therein. The TFT is formed partially or entirely using polysilicon. Each TFT has the gate thereof connected to one of the gate line, and the drain connected to one of the data line. When a gate pulse is applied to a gate line, a TFT corresponded to the gate line turns on so as to select a pixel corresponding to the TFT. In the pixel corresponded to the selected TFT, direction of alignment of the liquid crystal molecules is determined corresponding to the data voltage supplied to the data line, thereby transmittance is determined, and thereby gradation value of the pixel can be controlled.

Figure 2:
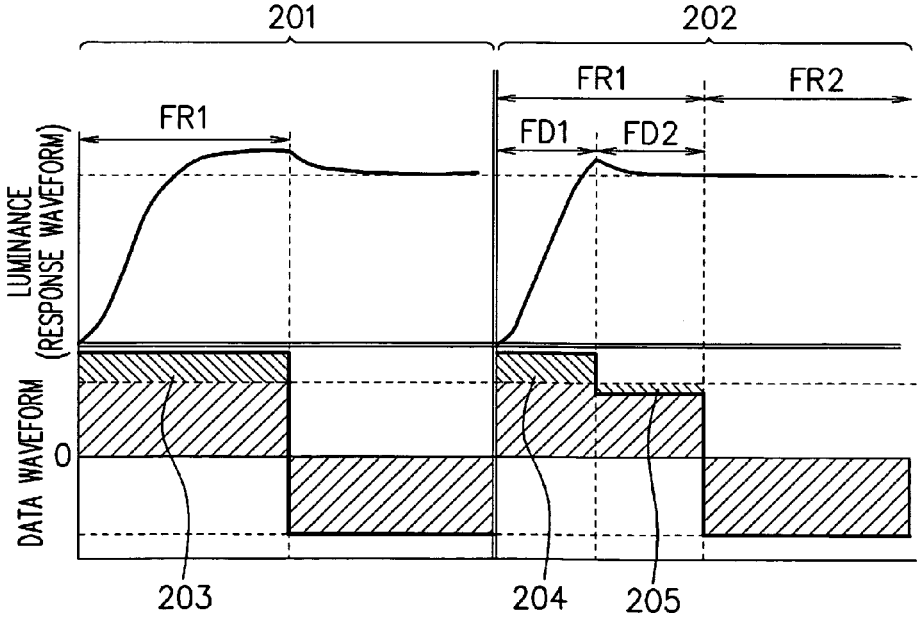
FIG. 2 is a drawing showing responses under frame division in the first embodiment.

FIG. 2 is a drawing showing normal overdrive operation 201 and one-frame-halved overdrive operation 202. In the drawings of the normal overdrive operation 201 and the one-frame-halved overdrive operation 202, the upper halves show response waveforms of luminance, and the lower halves show data waveforms. It is to be noted that 0 in the data waveforms does not mean the ground level. In the normal overdrive operation 201, the effective voltage expressed by the data waveform in the first frame increases by an increment 203.

In the one-frame-halved overdrive operation 202, the overdrive operation occurs while dividing the first frame FR1 into a first field FD1 and a second field FD2, getting rid of the overdrive operation in the second frame FR2. In the first field FD1, the overdrive operation is carried out while increasing the effective voltage as expressed by the data waveform by an increment 204, to thereby increase the response speed of luminance. In the second field FD2, the effective voltage expressed by the data waveform is decreased by a decrement 205. Gate pulses are supplied in a field-by-field manner to the gate lines. The data voltage waveform expresses that of alternating current type in which the positive-negative polarity inverts on the frame basis. All of n (2, for example) fields obtained by dividing one frame have the same polarity of data voltage.

An exemplary case where one frame is divided into two fields will be considered as the present embodiment. A drive circuit of a liquid crystal display device is equipped, as shown in FIG. 1, with a memory 106, and a data converter 105 correcting the data voltage. The data converter 105 compares the data in the previous frame and the current frame, reads a correction value out from a data conversion table in the memory 106 based on a result of comparison, and adds the value to the data signal of the current frame to thereby convert the data. The converted data is aimed at being applied from the timing controller 104 through the data driver 103 to TFT of the pixel. The conversion is effected to the data in two fields in one frame.

As shown in FIG. 2, the converted data of the first field FD1 has an effect of increasing the response speed of liquid crystal and of consequently increasing the response speed of the device, through application of a voltage higher than that intrinsically required at the rise-up time of data waveform. The converted data of the second field FD2 is applied for the purpose of recovering a desired level of pixel voltage down from the pixel voltage excessively applied in the first field FD1. In the case shown in the drawing, a voltage having a level slightly lower than the desired level is applied, in view of rapidly recovering the desired voltage level. The data correction of the second field FD2 is also effective for lowering in the luminance ascribable to abnormal alignment of liquid crystal molecules under high voltage application as described in the above.

Which voltage, higher than a desired level of data voltage or lower than that, should be applied to the second field FD2 is determined based on the degree of lowering in the luminance ascribable to such abnormal alignment, and a degree of recovery of the data voltage from the high level achieved in the first field FD1 to a desired level. It is to be noted herein that a voltage exceeding the intrinsic data voltage cannot be not applied exceptionally for response from the black level (minimum gradation value) to the white level (maximum gradation value), because the white level voltage is the maximum data voltage which can be output.

The one-frame-halved overdrive operation 202 was found to realize a middle-tone response of as fast as 8 ms or shorter over the entire gradation, whereas the normal overdrive operation 201 was only successful in achieving a response speed of 16 ms or shorter, and even 16 ms or longer in some cases. Use of the converted data also in the second field FD2 was successful in reaching a desired pixel potential within one frame FR1, and in realizing improvement in blurring and afterimage in the movie.

The above-described example has dealt with the case where the number of fields within a single frame was two, and the converted data voltage was applied to each of the frames, whereas the case of division into n frames also adopts data voltage application using such converted data for all of the frames. The pixel potential may reach the desired data voltage before the n-th field when n expresses a large number, wherein the converted data may become identical to the intrinsic data, such that a data corrected using a correction value of converted data of 0 is applied after the pixel data was stabilized.

Second Embodiment

The first embodiment has aimed at improving the response speed by applying the same data, as the pre-conversion data, to the first field FD1 and the second field FD2, whereas the second embodiment of the present invention will deal with the case where different pre-conversion data will be applied to the first field FD1 and the second field FD2.

As the data voltage, V1 is applied to the low-gradation first field FD1, and the black-level voltage (minimum gradation value) Vb are applied to the second field FD2. On the high gradation side, the white-level voltage Vw is applied to the first field FD1, and V3 is applied to the second field. The individual voltage values are selected so that target luminance values can be achieved for the individual frames, by time integral of data voltages V1 and Vb on the low gradation side, and of data voltages Vw and V3 on the high gradation side.

Figure 3:
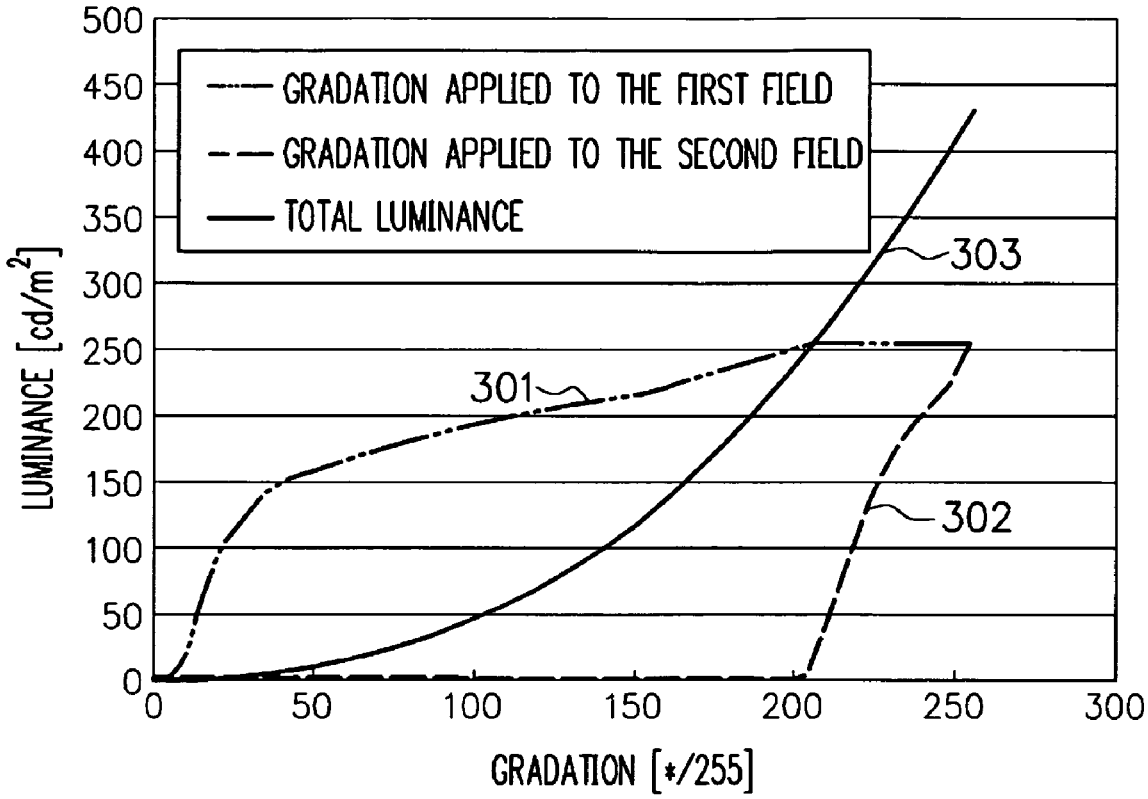
FIG. 3 is a drawing showing an exemplary selection of gradation in a second embodiment.

FIG. 3 is a drawing showing relations between the gradation and the luminance. A characteristic curve 301 represents a gradation applied to the first field FD1, a characteristic curve 302 represents a gradation applied to the second field FD2, and a characteristic curve 303 represents the total luminance.

The gradation where the voltage of the first field FD1 varies from V1 to Vw is the one where 255 gradations=Vw is necessary for V1 in order to achieve a necessary level of frame luminance, and falls on 200 gradations or around in an exemplary case shown in FIG. 3. The gradation (voltage) applied to the first field FD1, the gradation (voltage) applied to the second field FD2, and the changes in the total luminance show behaviors shown in FIG. 3. The total gradation-luminance characteristics of the first field FD1 and the second field FD2 herein is set so as to give $\gamma=2.4$.

The first object of setting such gradation resides in improvement in the response speed. Response characteristic of liquid crystal in the VA-mode display is known to be poor in response from middle tone to meddle tone. Known techniques for improving the response include two followings: (1) the liquid crystal molecules are pre-tilted by preliminarily applying a voltage equal to, or at around the black level voltage, to thereby improve responsiveness towards the next gradation; and (2) voltage value for the gradation to be finally reached is raised because the higher the gradation to be finally reached rises, the better the responsiveness becomes.

The latter corresponds to the principle of overdrive. Possibility of applying a voltage other than the black-level voltage is a provision for the case where application of an appropriate middle tone voltage may result in a more rapid response rather than the preliminarily application of the black-level voltage.

The selection of gradation in this embodiment raises effects of improving the response speed ascribable to that a voltage higher than the conventional gradation voltage can be applied in the first field FD1 on the low gradation side, and of improving the responsiveness towards the next frame as a result of fixing the second field FD2 to the black level voltage. It also raises an effect of improving the responsiveness as continued from the previous second field FD2 as a result of fixation at the white-level voltage in the first field FD1 on the high gradation side.

The second object is to improve the movie characteristics. If the liquid crystal could perfectly respond under application of the black-level voltage to the second field FD2 on the low gradation side, only the first field FD1 will contribute to the luminance. This means an impulse-type display is realized based on a hold-type display which is poor in movie characteristics by principle.

The third object is to improve the viewing angle characteristics. Necessity of provision of a plurality of gradation-luminance characteristics in a single pixel or on a time scale in view of improving the gradation-viewing angle characteristics has been described previously in this specification, and none other than this gradation selection method adopts such methodology on the field basis in one frame. In other words, an effect of half-tone operation can be obtained under doubled-speed operation.

This embodiment enables a halftone operation at n-fold speed. The n-fold-speed halftone operation is such as providing a plurality of gradated displays differing from each other in a plurality of fields on the pixel basis, to thereby achieve a target luminance on the time average basis.

It has already been known that larger difference between two gradation-luminance characteristics results in a larger effect of improving the gradation-viewing angle characteristics. The second field FD2 is therefore fixed to the black-level voltage Vb on the low gradation side, and the first field FD1 is fixed to the white-level voltage Vw on the high gradation side.

It is to be noted herein that responsiveness of the second field FD2 towards the black level holds the key for obtaining a desired effect of improving the movie characteristics and gradation-viewing angle characteristics based on such data voltage application. The responsiveness will be of no critical importance for the first field FD1 applied with the overdrive (OD), whereas it will be important for the liquid crystal to have a good responsiveness to the black-level voltage applied to the second field FD2, because a voltage smaller than the black-level voltage cannot be applied. Use of any liquid crystal having a slow response speed will allow the luminance to fall only to an insufficient blackness, providing only a limited effect of improving the movie characteristics.

In other words, any liquid crystal having only a slow response speed essentially needs the overdrive (OD) applied also to the second field FD2. In this case, the voltage to be set in the second field FD2 on the low gradation side is preferably selected to a voltage expressing 4 to 16 gradations. Application of any voltage exceeding this level may reduce the effect of the impulse-type display, and may reduce the effect of improving the gradation-viewing angle characteristics.

For the case where the first field FD1 shows only a slow responsiveness to the white-level voltage, intentional lowering in the white-level voltage successfully allows use of overdrive (OD). Exemplary methods of lowering include a method of lowering the white level voltage according to its literal sense, and a method of using a driver allowing higher voltage application, while keeping the white-level voltage unchanged.

The former method is associated with lowering in the luminance, and therefore cannot allow extreme lowering, whereas the application of a high voltage under lowered white-level voltage results in overshooting in the response waveform, causing adverse effects on the movie characteristics. It is therefore appropriate in a practical sense to effect the lowering to an exemplary level of 240 gradations or around.

It is now made possible to use the overdrive in both responses from black to white, and white to black, by disusing the possibly-applicable maximum and the minimum voltages as the white-level voltage and the black-level voltage, respectively, and instead by allowing the residual voltages within such range to cover the range from the white-level voltage to the black-level voltage.

As has been described in the above, in the last field out of the plurality of fields, the data line is applied with a first constant voltage [black-level (minimum gradation value) voltage or a voltage close to the black-level voltage], for the frame data ranging from the minimum gradation value to a first gradation value. On the other hand, in the top field out of the plurality of fields, the data line is applied with a second constant voltage [white-level (maximum gradation value) voltage or a voltage close to the white-level voltage] larger than the first constant voltage, for the frame data ranging from a second gradation value to the maximum gradation value.

Third Embodiment

Division of one frame into two fields can also shorten the write time to the pixels. In 60-Hz operation, the gate pulse time in the normal operation under the XGA resolution is given as 1/60/768=21.7 μs, whereas division into two fields gives a halved gate pulse time of 10.9 ξs. The gate pulse is applied to the gate lines in a field-by-field manner. It is apparent that one frame divided by n fields can further shorten the gate pulse time.

A problem possibly raised herein relates to write ability of the TFT. Division of one frame into two fields is aimed at improving the response speed, whereas an insufficient state of write operation is not only unsuccessful in improving the response speed, but also unsuccessful in compensating variation in the driving ability of TFT depending on environment in which the liquid crystal panel is placed, and in ensuring reliability.

In this case, a multi-scanning operation of the gates is adopted as a method of ensuring a sufficient level of write ability, under field division for improving the response speed.

Figure 4:
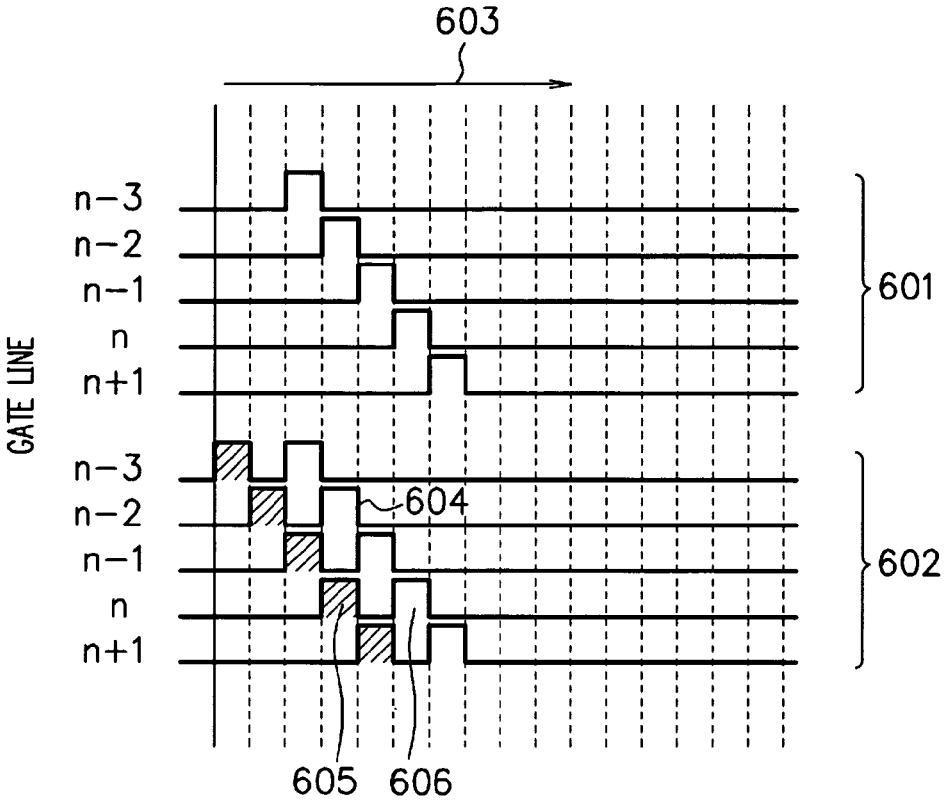
FIG. 4 is a drawing showing a concept of multi-scanning operation of a third embodiment.

FIG. 4 is a drawing showing normal operation 601 and multi-scanning operation 602. Arrow 603 indicates the time axis. The normal operation 601 supplies one pulse per every single gate line. In contrast to this, the multi-scanning operation 602 supplies two gate pulses for preliminary writing and main writing in a field-by-field manner to every single gate line. For example, this is a method of providing a preliminary writing gate pulse 605 on the n-th gate line, when a writing pulse 604 is applied to the (n−2)-th gate line, so as to enable simultaneous writing into two lines. Writing in the n-th line repeated twice by the preliminary writing gate pulse 605 and the main writing gate pulse 606 successfully compensates poor writing ability of the TFT. The number of times of preliminary writing is, of course, not limited to one, allowing two or more times of preliminary writing if the write operation is carried out so as to write on the n-th line when the write operation is made on the [n−(even number)]-th gate line.

The reason why the preliminary writing is made on the (even number)-th line preceding to the n-th line is to make agreement in polarity of the written pixels. A mode of operation assumed herein is a dot inversion operation allowing alternate inversion of polarities of the data voltage in the direction of pixel arrangement. Also longitudinal line inversion occurs in a similar manner.

Figure 5A:
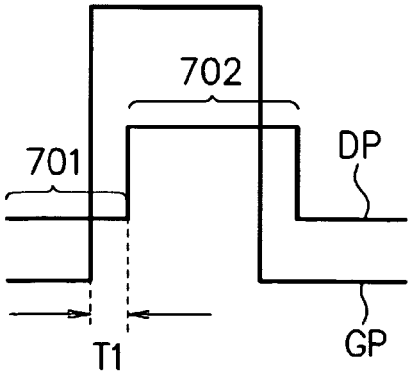
FIGS. 5A and 5B are drawings showing data holding time in the third embodiment.

A problem raised herein relates to data holding time. As shown in FIG. 5A, the data holding time T1 refers to a time lag between the rise-up times of a data pulse DP and a gate pulse GP, and is generally set to 2 to 3 ms or around, taking rounding in waveform of the gate pulse GP into account. The gate pulse GP is a pulse applied to the gate lines, and the data pulse DP is a pulse applied to the data lines. The gate pulse GP generally rises up in advance. The multi-scanning operation 602 makes preliminary writing in the pixels on the n-th line, and the voltage is retained unchanged until the main writing occurs on the n-the line. The data pulse DP has a negative-polarity data voltage 701 on the (n−1)-th line and a positive-polarity data voltage 702 on the n-th line. When the gate pulse GP rises up in the main writing on the n-th line, the preliminarily written voltage is lowered, because the data pulse DP written herein is a counter-polarity data 701 on the (n−1)-th line.

Figure 5B:
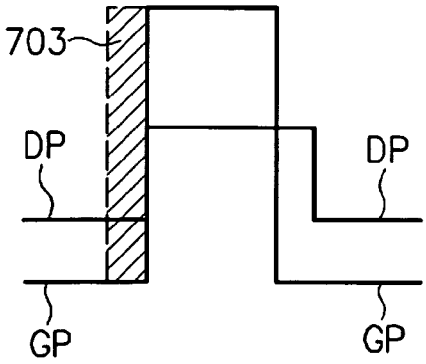
Figure 6:
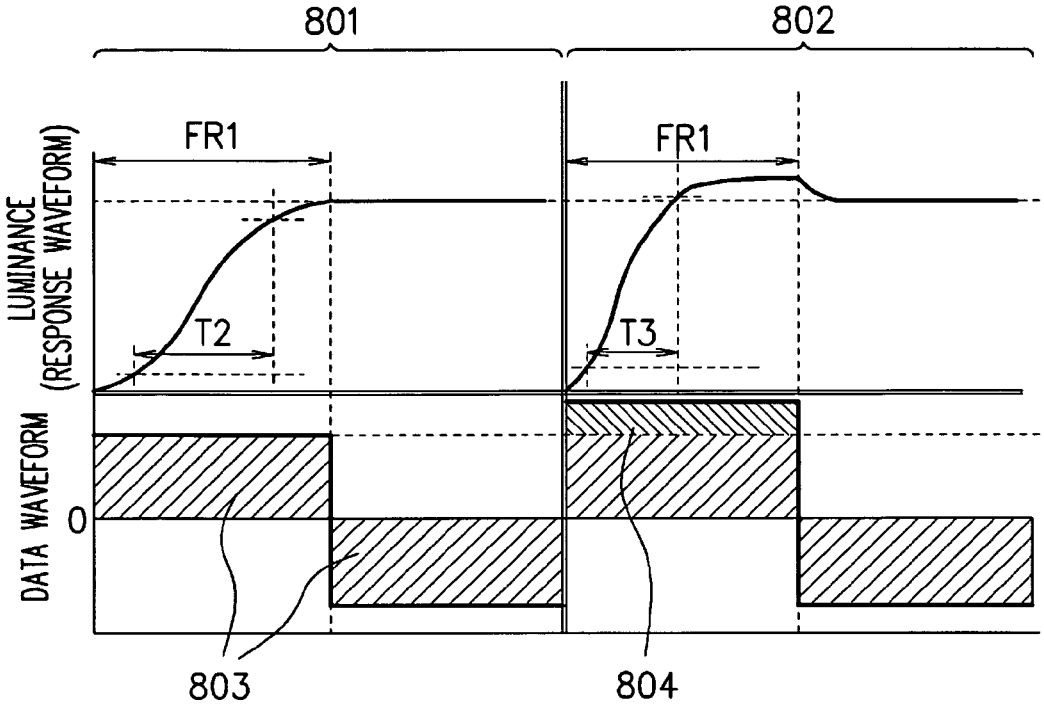
FIG. 6 is a drawing showing the overdrive technique in the conventional art.
Figure 7:
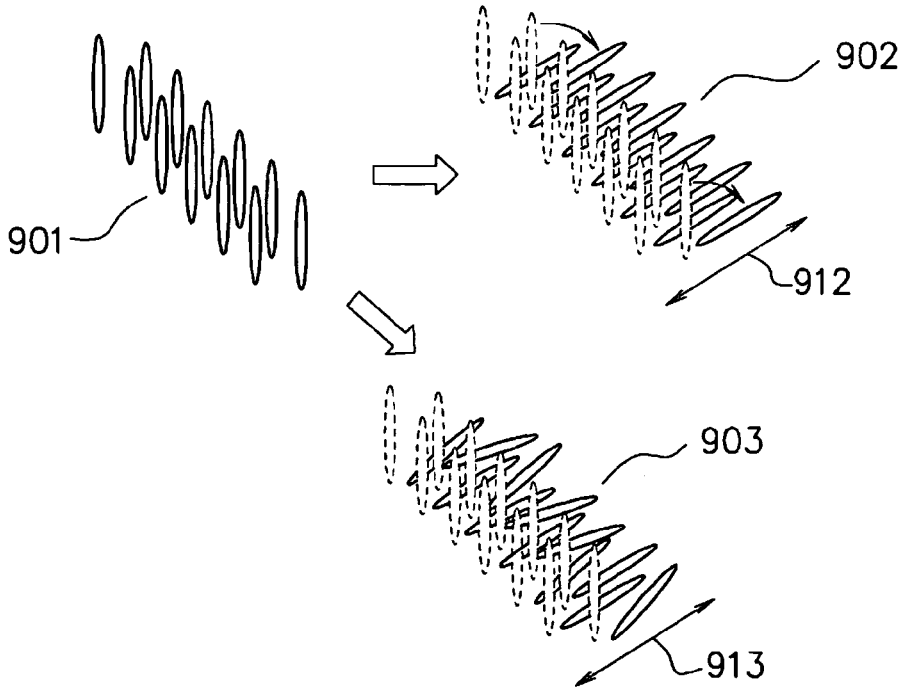
FIG. 7 is a drawing showing abnormal alignment of liquid crystal molecules under high voltage application in the conventional art.
Figure 8:
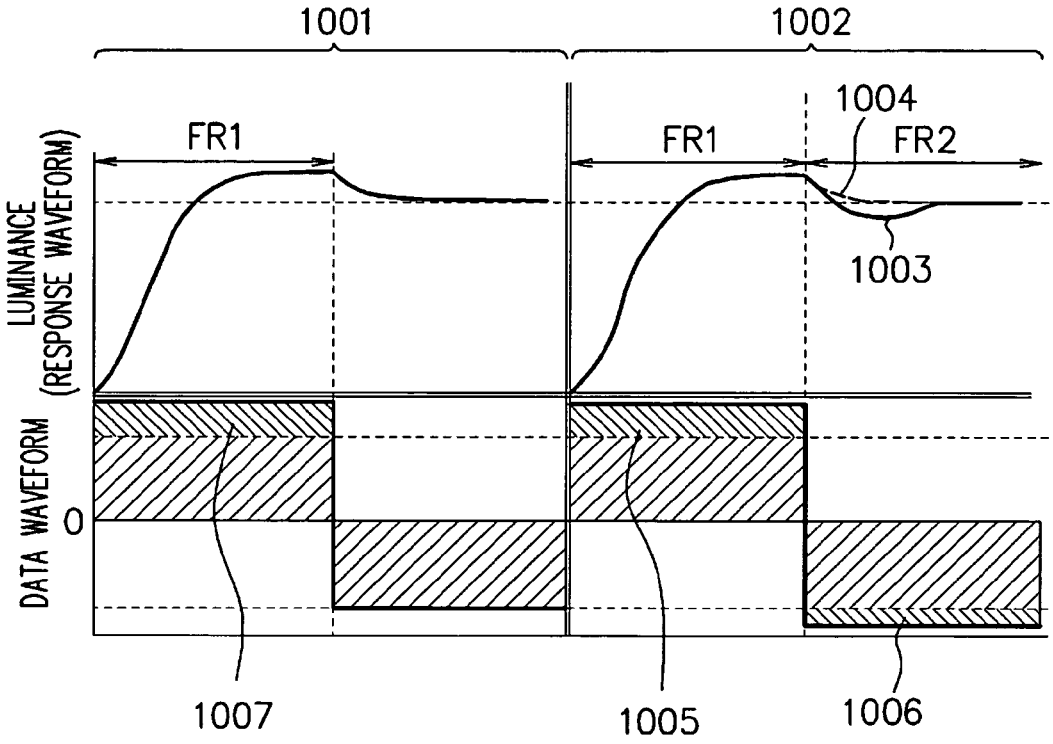
FIG. 8 is a drawing showing a response waveform under abnormal alignment of liquid crystal molecules in the conventional art.
Figure 9A:
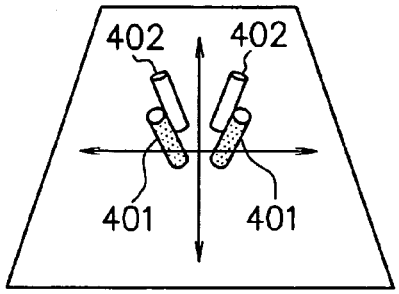
FIGS. 9A and 9B are drawings showing gradation-viewing angle characteristics in the conventional art.
Figure 9B:
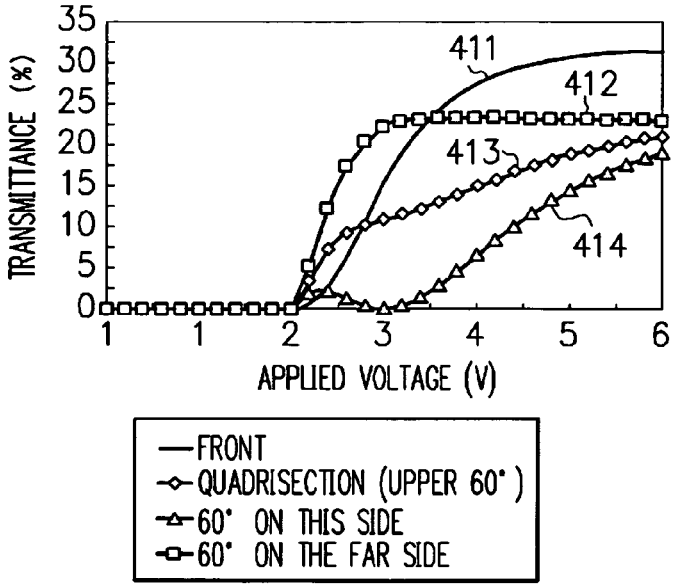

In order to avoid such lowering, it is effective to adjust the data hold time T1 substantially zero. More specifically, as shown in FIG. 5B, the gate pulse 703 is omitted selectively in the data hold time T1 between the rise-up of the gate pulse GP and the rise-up of the data pulse DP. The gate pulse GP can now rise up at the same time with the data pulse DP. It is no more necessary to write the counter-polarity data, and it is also made possible to cope with the rounding of the gate pulse waveform by ensuring a sufficient data hold time at the drop-down time of the gate pulse GP. It is still also made possible to realize the two-field divisional operation capable of keeping a sufficient level of writing ability, and thereby to improve the response speed.

Fourth Embodiment

The fourth embodiment of the present invention will be described in the next. The writing ability of the TFT varies depending on temperature. This is because the mobility in a-Si (amorphous silicon) varies depending on temperature, showing extreme degradation at low temperatures. Even though the n-fold-speed operation could be accomplished with a thorough degree of writing at normal temperature, the writing may be incomplete at low temperatures, and may even result in non-uniform display in a partial region or over the entire surface of the panel.

One possible method of avoiding such incomplete writing may be increase in the TFT size other than the case of multi-scanning as described in the third embodiment, but the method is available only in a trade-off with aperture, and may be causative of lowered yield ratio.

There is now proposed a method of avoiding the incomplete writing, in which a temperature measuring element is provided to the driving circuit, so as to give a function of switching from the n-fold-speed operation to the normal operation at a predetermined temperature or below. The problems in the aperture and yield ratio are thus avoidable even when the n-fold-speed operation is carried out using TFT as large as the conventional one. The liquid crystal is intrinsically poor in the responsiveness under low temperatures and can show only a limited effect of n-fold-speed operation, so that the method never results in an extreme degradation in the movie characteristics, and can certainly prevent the display quality from degrading due to incomplete writing.

At which temperature the switching should occur is determined depending on the write ability of TFT (mobility performance of a-Si) on the panel to be used, and the number of "n" in the n-fold-speed.

The write ability of TFT varies depending also on frequency. This is because the pulse width of the gate voltage may be narrowed for some frequency, and therefore returning the operation back to the normal operation at and above a predetermined frequency is also understood as one means for avoiding the above-described problem. More specifically, a function of monitoring the frequency is provided to the driving circuit, so as to inhibit the n-fold-speed operation at and above a predetermined frequency.

Operation at the temperature and frequency other than those described in the above may be half-tone operation. The half-tone operation is a method of obtaining half-tone display using display frames based on the FRC (frame rate control) operation. The FRC operation is generally understood as a method of realizing an expression based on a larger number of gradations, and is known to produce a middle tone based on combination of display gradations of the pixels on the frame basis and the number of illuminated pixels. A half-tone effect can be obtained by appropriately selecting these display gradations. One example of the selectable gradations may be such as that shown in FIG. 3 explained above in the second embodiment. In this case, different gradation-luminance characteristics are applied to the first frame FD1 and the second frame FD2, proving an effect of improving the gradation-viewing angle characteristics. A desirable display can therefore be maintained without causing variation in the gradation-viewing angle characteristics possibly induced by switching of the operation.

As has been described in the above, the liquid crystal display device of this embodiment detects temperature of the liquid crystal display device by the temperature detection section in the timing controller 104. The data converter 105 divides one frame into a plurality of fields when the detected temperature falls within a predetermined range, and converts a frame data into a field data, and the data driver 103 supplies the field data to the data line. When the detected temperature falls outside the predetermined range, the normal operation (operation without dividing one frame), or the half-tone operation (operation achieving a target luminance on the time average basis, by carrying out on the pixel basis a plurality of gradation displays differing from each other in a plurality of frames) is carried out.

Input frequency is detected by a frequency detecting section in the timing controller 104. The data converter 105 divides one frame into a plurality of fields when the detected frequency falls within a predetermined range, and converts a frame data into a field data, and the data driver 103 supplies the field data to the data line. When the detected temperature falls outside the predetermined range, the normal operation (operation without dividing one frame), or the half-tone operation (operation achieving a target luminance on the time average basis, by carrying out on the pixel basis a plurality of gradation displays differing from each other in a plurality of frames) is carried out.

Fifth Embodiment

The fifth embodiment of the present invention will deal with the case where one frame is halved similarly to as in the foregoing embodiments. When a voltage equal to or around the black-level voltage is applied to the second field FD2 on the low gradation side as described in the fourth embodiment, a combination of gradations capable of causing a maximum difference between the first field FD1 and the second field FD2 is 255 gradations for the first field FD1 and 0 gradation (or several gradations) for the second field FD2, and such inter-field difference in the brightness under a 120-Hz operation is observed as a 60-Hz flicker. Because a larger difference in the gradation results in a more distinct flicker, and because a frequency of 60 Hz is recognizable by human, the above combination may sometimes worsen the display quality due to the flicker, despite improvement in the movie characteristics.

The flicker may be reduced by increasing the number of division of one frame, but this is not so practical at present because of the above-described problem in the writing ability of TFT. Then an alternative method of minimizing the flicker is to stop application of the black-level voltage to the second field FD2, and to return the operation from the n-fold-speed operation back to the normal operation, when still image is displayed.

Still image and movie are discriminated on the circuit basis. Discrimination is made similarly to operations in the overdrive circuit, by comparing data between the previous frame and the next frame so as to find any variation in the data. This is successful in realizing a doubled-speed operation in which still image, in particular such as having the same color in a large area and therefore being more likely to highlight the flicker, is displayed without flicker, and movie which is less likely to highlight flicker (flicker to some degree is permissible on the practical basis) is displayed with an excellent movie characteristics. The above-described operation during still image display may be the half tone operation described in the fourth embodiment.

As has been described in the above, the timing controller 104 discriminates movie or still image, divides one frame into a plurality of fields when movie was discriminated, converts a frame data into a field data, and the data driver 103 supplies the field data to the data line. When still image was discriminated, the normal operation (operation without dividing one frame), or the half-tone operation without the n-fold-speed operation is carried out.

Sixth Embodiment

The sixth embodiment of the present invention will deal with the case where one frame is divided into two frames equally on the time basis, similarly to as in the foregoing embodiments. Assuming now that an input data for each of two fields contains 8 bits, entering of two types of 8-bit data to one frame enables a 16-bit-equivalent gradation expression. In other words, one frame divided into n fields enables an expression of a×n gradations for the number of input bit of "a". For example, the first field FD1 having an input of a single gradation, and the second field FD2 having an input of two gradations enables an expression of luminance corresponded to 1.5 gradations. Provision of a driving circuit such as allowing arbitrary setting of the divided time will enable substantially infinite expression of gradation.

As has been described in the above, the first to sixth embodiments provide a liquid crystal display device characterized in that one frame is divided into n fields, and that the data voltage after being processed by a predetermined conversion is applied to every field, to thereby realize response within a period not longer than 1/n frame period. The responsiveness of the liquid crystal is further improved by appropriately selecting voltage value to be applied to the individual fields, and thereby also the gradation-viewing angle characteristics are improved.

Division of one frame period into n fields, application of converted data as the data voltage to every divided field, and appropriate selection of voltage values to be applied to the a-th field and the (a+1)-th field make it possible to provide a liquid crystal display device excellent not only in the response speed but also in the movie characteristics, and successfully improved in the viewing angle characteristics and display quality.

It is to be noted that one frame may be divided into n fields each having an arbitrary field length of time, instead of having a uniform field length of time.

The present embodiments are successful in increasing the response speed and in improving the movie characteristics. It is also made possible to improve the gradation-viewing angle characteristics.

The above-described embodiments are presented merely as specific examples for carrying out the present invention, and by which the technical scope of the present invention should not limitatively be understood. That is, the present invention can be embodied in various modified forms without departing from the technical spirit and principal features thereof.

What is claimed is:

1. A liquid crystal display device comprising:

a liquid crystal panel including a plurality of gate lines selecting pixels and a plurality of data lines supplying pixel data; and a data driver dividing one frame into a plurality of fields to thereby convert a frame data into a field data, and supplying said field data to said data lines, wherein the data driver is configured to apply a first constant voltage to said data lines in a last field out of said plurality of fields for said frame data in a range from a minimum gradation value to a first gradation value, and apply a voltage in accordance with said frame data in fields other than said last field for said frame data in the range from the minimum gradation value to the first gradation value, and the data driver is configured to apply a second constant voltage larger than said first constant voltage to said data lines in a top field out of said plurality of fields for said frame data in a range from a second gradation value to a maximum gradation value, wherein the first gradation value is less than the second gradation value, and apply a voltage in accordance with said frame data in fields other than the top field out of said plurality of fields for said frame data in the range from the second gradation value to the maximum gradation value.

2. The liquid crystal display device according to claim 1, wherein said first constant voltage is a voltage expressing the minimum gradation value, and said second constant voltage is a voltage expressing the maximum gradation value.

* * * * *